US008220216B2

(12) United States Patent
Pulley

(10) Patent No.: US 8,220,216 B2
(45) Date of Patent: Jul. 17, 2012

(54) SELF LOUVER OPENING

(75) Inventor: Stephen L. Pulley, Carmel, IN (US)

(73) Assignee: Carrier Corporation, Farmington, CT (US)

( * ) Notice: Subject to any disclaimer, the term of this patent is extended or adjusted under 35 U.S.C. 154(b) by 926 days.

(21) Appl. No.: 12/187,910

(22) Filed: Aug. 7, 2008

(65) Prior Publication Data

US 2008/0293351 A1 Nov. 27, 2008

Related U.S. Application Data

(63) Continuation of application No. PCT/US2006/004276, filed on Feb. 7, 2006, and a continuation of application No. 12/162,031, filed as application No. PCT/US2006/004276 on Feb. 7, 2006, now abandoned.

(51) Int. Cl.
*E06B 7/08* (2006.01)

(52) U.S. Cl. ..... 52/473; 52/75; 52/78

(58) Field of Classification Search ..... 52/473, 52/198, 199, 75, 78

See application file for complete search history.

(56) References Cited

U.S. PATENT DOCUMENTS

| | | | | |
|---|---|---|---|---|
| 4,419,300 | A | 12/1983 | VanNess et al. | |
| 4,680,910 | A | 7/1987 | Perk | |
| 4,712,501 | A | 12/1987 | Whitley, II | |
| 4,723,419 | A | 2/1988 | Kessler et al. | |
| 4,902,066 | A * | 2/1990 | Norman | 296/180.1 |
| 4,976,115 | A | 12/1990 | Hogan | |
| 5,226,293 | A * | 7/1993 | Brock | 62/304 |
| 5,624,313 | A | 4/1997 | Nonaka et al. | |
| 6,322,441 | B1 | 11/2001 | Darcey | |
| 6,439,991 | B1 | 8/2002 | Jarnot | |
| 6,554,700 | B2 * | 4/2003 | Dixon | 454/365 |
| 6,705,105 | B2 | 3/2004 | Wendt et al. | |
| 6,966,156 | B2 * | 11/2005 | Dixon | 52/199 |
| 2004/0099001 | A1 | 5/2004 | Wendt et al. | |

OTHER PUBLICATIONS

International Search Report and Written Opinion mailed Feb. 9, 2007 (8 pgs.).

* cited by examiner

*Primary Examiner* — William Gilbert
*Assistant Examiner* — Chi Q Nguyen
(74) *Attorney, Agent, or Firm* — Cantor Colburn LLP

(57) ABSTRACT

A louvered housing for an air conditioning unit includes a base structure with a plurality of openings and elongated bodies with a V-cross-sectional shapes and being connected to the base structure at their ends. The louvers are formed in a two-step process including first a stamping and then a forming process, with neither step resulting in scrap material.

5 Claims, 5 Drawing Sheets

SELF LOUVER OPENING

CROSS-REFERENCE TO RELATED APPLICATIONS

This application is a continuation of International Patent Application Serial No.: PCT/US06/04276, which was filed on Feb. 7, 2006, and a continuation of U.S. patent application Ser. No. 12/162,031, filed Jul. 24, 2008, now abandoned which is a U.S. national stage application under 35 USC 371 of International Patent Application Serial No.: PCT/US06/04276 filed on Feb. 7, 2006.

BACKGROUND OF THE INVENTION

This invention relates generally to air conditioning systems and, more particularly to an improved louver structure and method of making same.

The outdoor unit of an air conditioning/heat pump system includes a heat exchanger coil that is generally round or rectangular in shape with a fan, a compressor and various other components mounted within. Wrapped around the outer side of the heat exchanger coil is a housing to protect the internal components from the elements and to provide a pleasing appearance to the unit which is generally located near the home.

During periods in which the outdoor unit is in operation, the compressor is turned on to cause refrigerant to be circulated through the system, and the fan is turned on to cause air to be drawn in from the outside, pass through the heat exchanger coil and be discharged upwardly into the atmosphere. In order for the air to pass through the housing, it is, of course necessary to provide openings in the housing for that purpose. This is generally accomplished by way of a welded wire mesh grill or a sheet metal louvered structure, with the louvers being designed such that they allow sufficient air to pass through the housing while at the same time, providing the necessary closure to ensure proper protection of the internal components and a pleasant appearance to the observer in the vicinity.

In addition to the above requirements, a louver structure is preferably designed such that it is economical to manufacture. Thus, the processes should be relatively few and simple, and the waste or scrap material should be minimal.

SUMMARY OF THE INVENTION

Briefly, in accordance with one aspect of the invention, the louver structure is formed with a plurality of elongated inwardly extruded safe-to-touch edged openings, each opening with an inwardly formed V-shaped element that is attached only by a pair of tabs at the ends thereof. Such a design provides for the necessary flow of air therethrough, is economical to manufacture, minimizes waste of raw material, presents an attractive appearance with minimal sharp edges and maximizes the protection of the internal components from the elements.

In accordance with another aspect of the invention, the louver structure is fabricated by two-step process of stamping and forming. A sheet metal plate is first stamped to obtain a plurality of elongated members that are separated from the plate except for a pair of tabs at their ends. In the forming step, the elongate members are extruded inwardly to form a V-shaped element, and the surrounding edges of the opening are pushed up to form a ridge around the opening.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
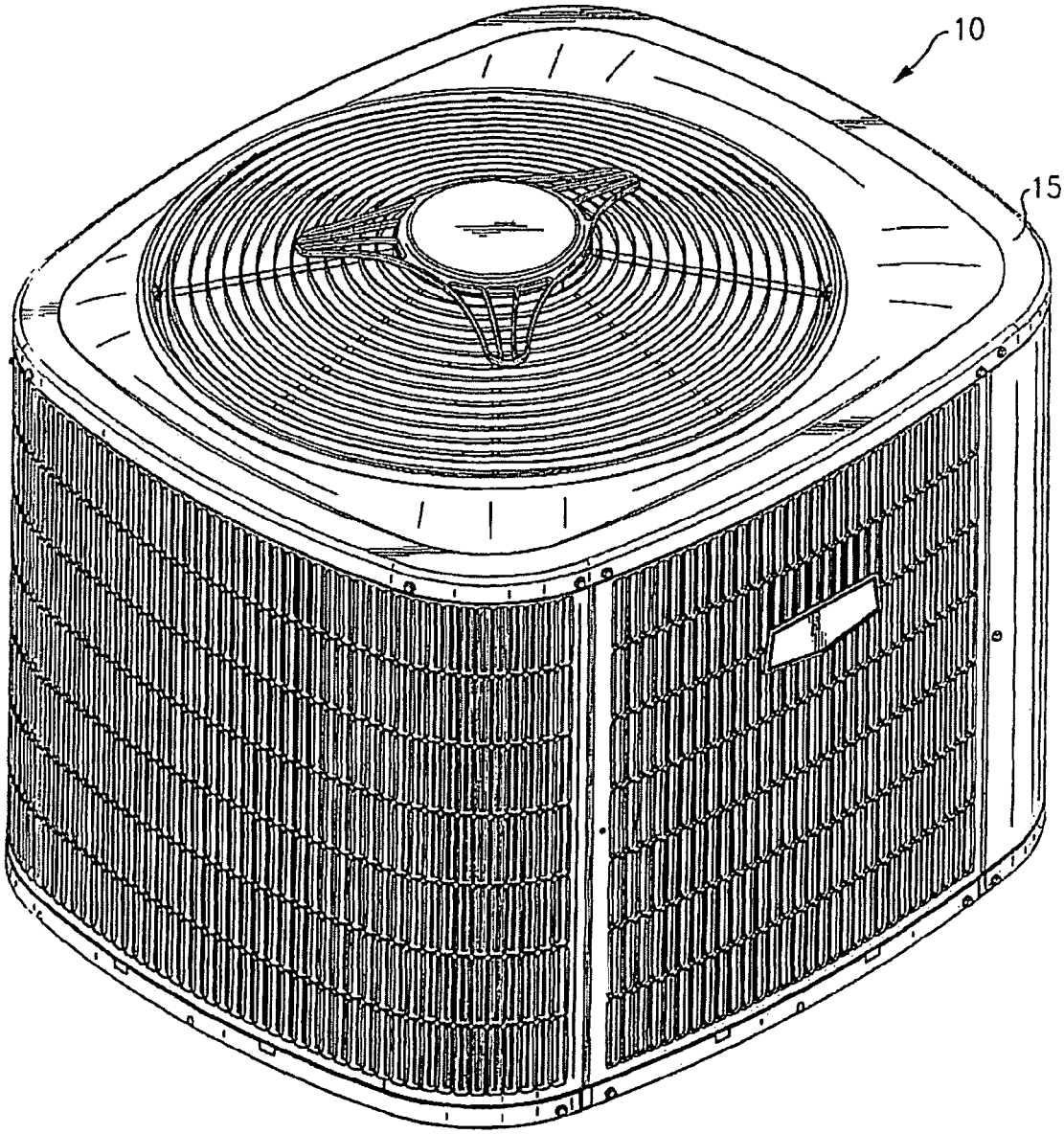
FIG. 1 is a perspective view of an air conditioning unit with the present invention incorporated therein.

Referring now to FIG. 1, the invention is shown generally at 10 as applied to an outdoor unit 15 of an air conditioning system.

Figure 2:
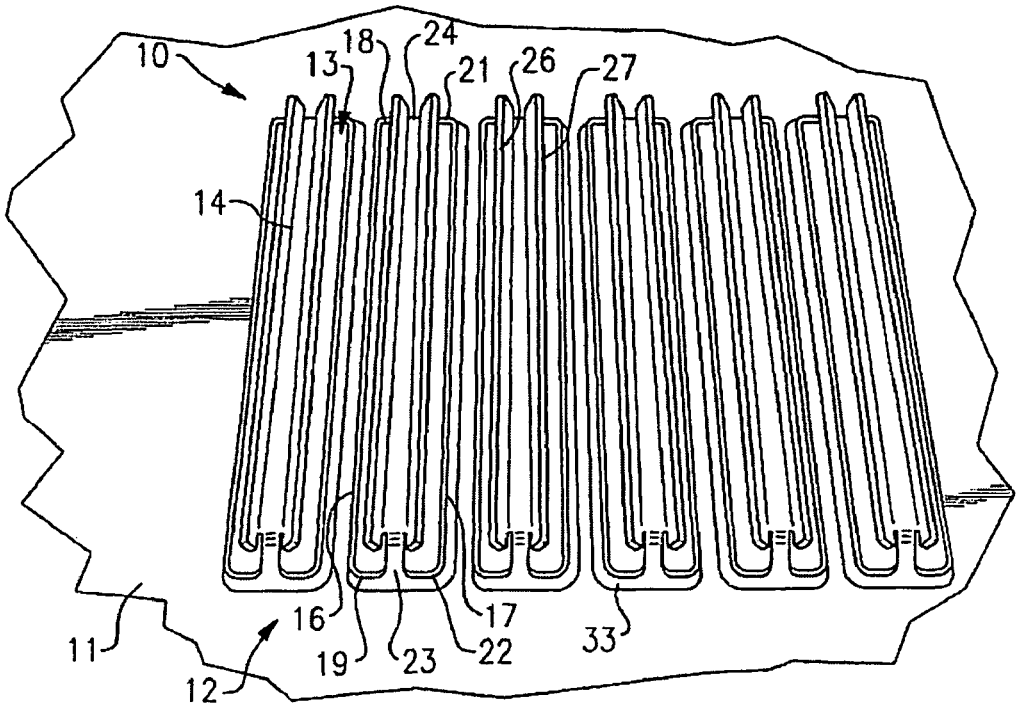
FIG. 2 is a perspective view of a representative louver panel in accordance with one aspect of the invention.

As will be seen in more detail in FIG. 2, a sheet metal plate 11 has a plurality of laterally spaced louvers 12 formed therein. Each louver 12 includes an opening 13 and an elongate member 14. Each opening 13 has a pair of laterally spaced side edges 16 and 17. Contiguous with the side edge 16 are end edges 18 and 19, and contiguous with side edge 17 are end edges 21 and 22. Between end edges 19 and 22 is a tab 23, and between end edges 18 and 21 is a tab 24, with the tabs 23 and 24 interconnecting the elongate member 14 to the plate 11.

Figure 3:
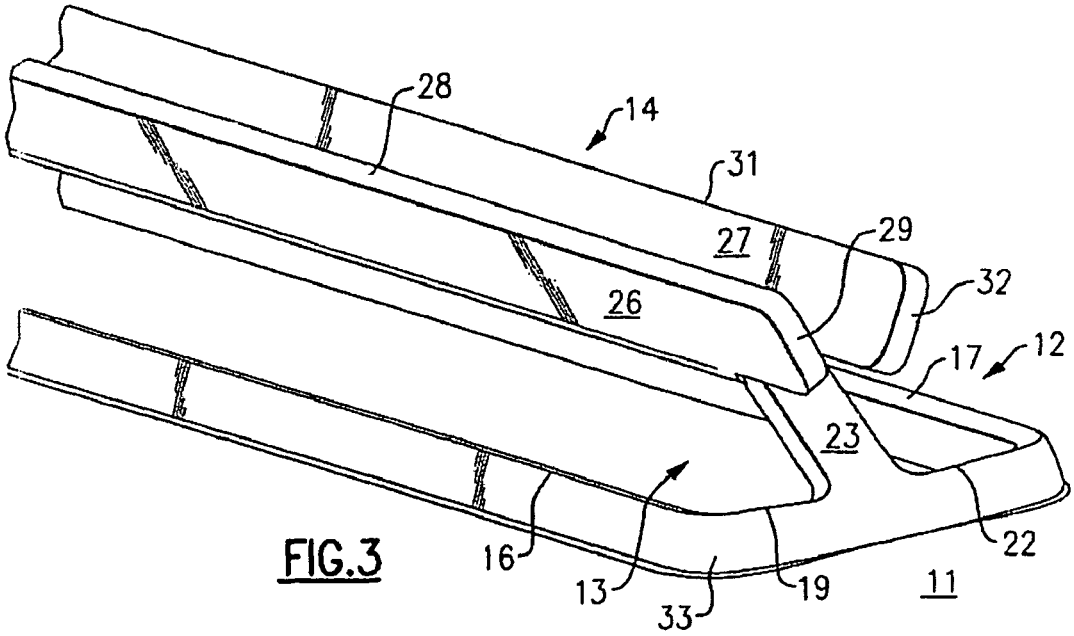
FIG. 3 is a partial perspective close-up view thereof.

The elongate body 14 includes a pair of side members 26 and 27 that extend inwardly from the opening 13 at an angle to form a V-shape as can be seen in both FIG. 2 and FIG. 3. Side member 26 has a longitudinal edge 28 and an end edge 29, while side member 27 has a longitudinal edge 31 and end edge 32. As will be seen in FIGS. 2 and 3, each of the edges 16-21 are extruded inwardly away from the face plate 11 to form a ridge 33.

Figure 4:
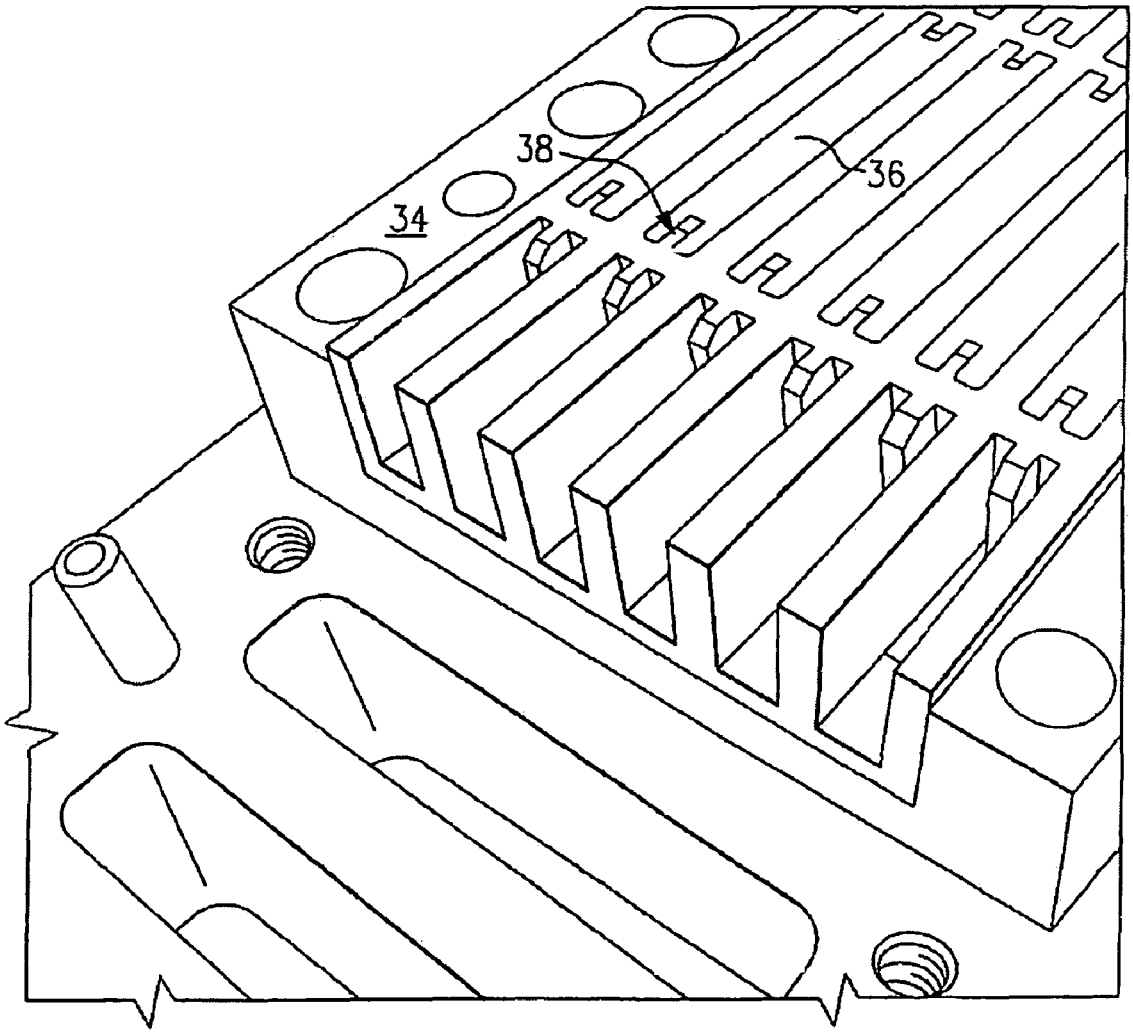
FIG. 4 is a perspective view of a die used for the blanking operation.
Figure 5:
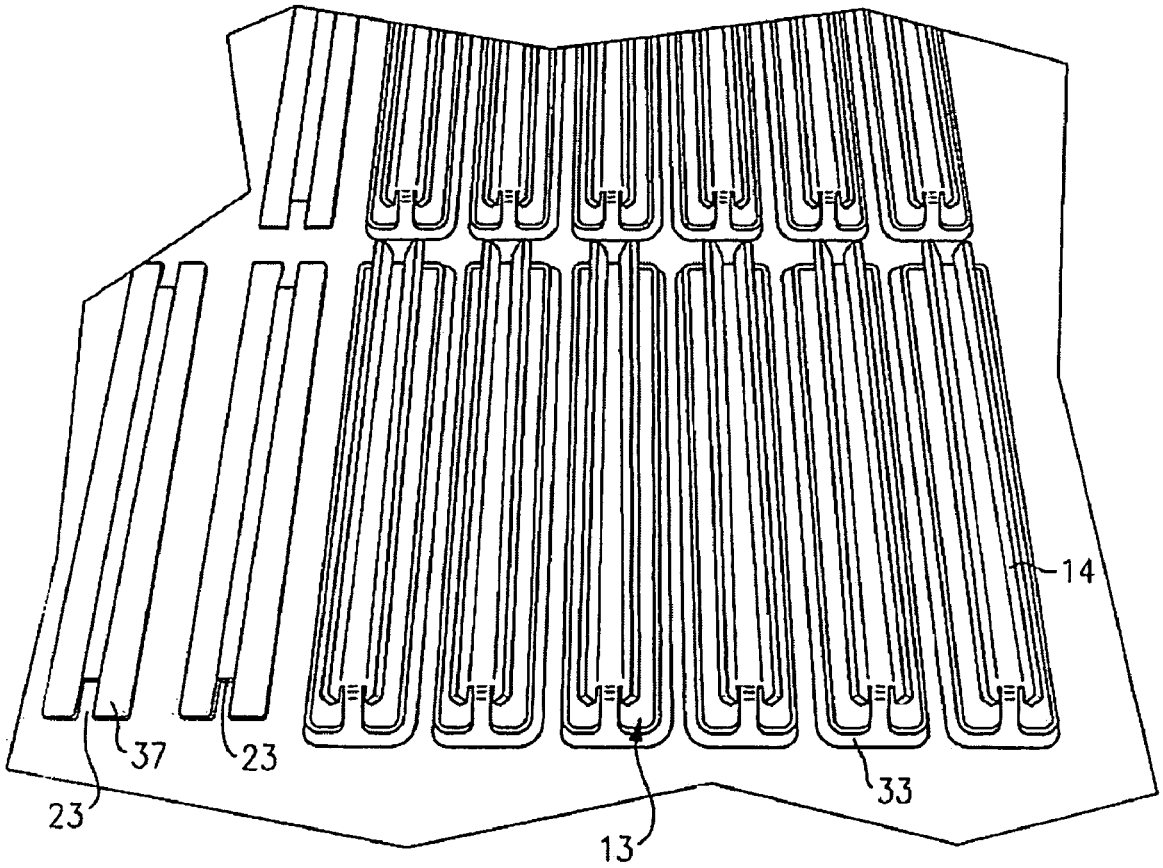
FIG. 5 is a perspective view of a plate showing the stages of both the blanking operation and the forming operation applied thereto.
Figure 6:
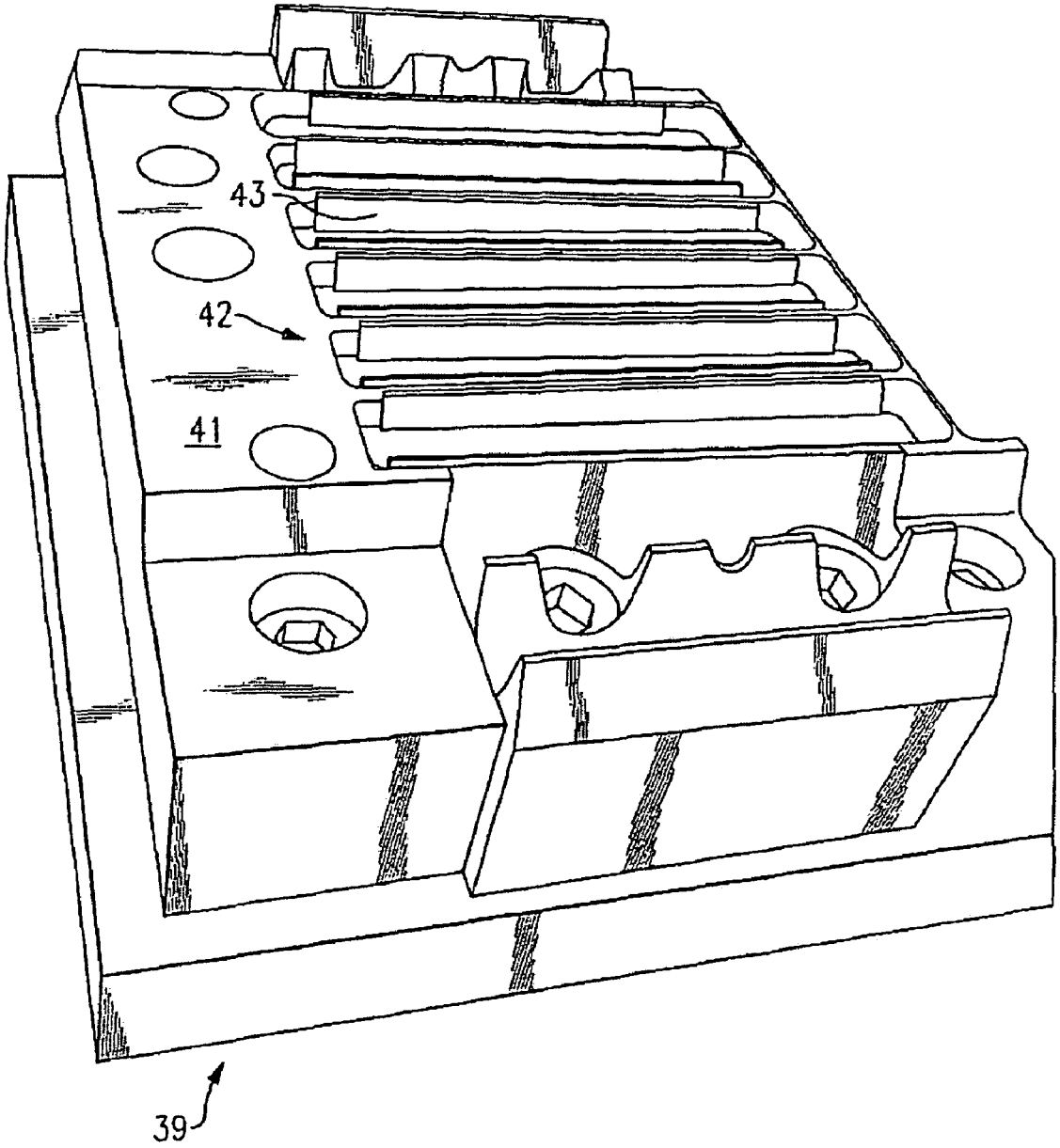
FIG. 6 is a perspective view of the die used for the forming operation.

Having described the louver structure, the method of fabricating the louvered member will now be briefly described with references given to FIGS. 4-6. The die to be used in the stamping process is shown in FIG. 4 and comprises a body 34 and a plurality of transversely spaced die elements 36 which act in a ganged manner to stamp out the H-shaped blanks 37 as shown in FIG. 5. Here it will be seen that the openings 38 in the die elements 36 result in a tab 23 at each end of the blanks 37 to maintain the connection with the plate 11. There is no waste or scrap material that results from this punching process.

Referring now to FIG. 6, there is shown a die 39 that is used for the forming or extruding process. The die body 41 includes a plurality of laterally and longitudinally spaced die elements 42, with each having a centrally disposed and longitudinally extending edge 43. When advanced against the H-shaped blanks 37, the side members are pushed inwardly to form the V-shaped elongate body 14 as shown on the right side of FIG. 5. At the same time, the connecting tabs 23 are extruded inwardly as shown, and all of the edges of the openings are extruded inwardly as shown to form the ridges 33.

Like the stamping process, the forming process also results in no scrap material. At the same time the finished louvers can be formed around a comfort system outdoor unit to provide an attractive and effective housing to protect the internal components of the unit. For that purpose, the panels are orientated with the openings 13 and the elongate bodies being vertically disposed as shown in FIG. 1.

I claim:

1. A louvered panel for housing an air conditioning unit, comprising:

a base plate;

a plurality of openings formed in said base plate, said openings having longitudinally extending side edges and transversely extending end edges, said end edges each having two laterally spaced portions adjacent their respective side edges;

each of separate body members positioned above each of said openings, said body member extending substantially along the longitudinal length of each of said openings and being substantially V-shaped in cross-sectional form, with the open legs of the V-shaped body extending generally away from said opening; and each of separate tab members associated with each of said end edges and being disposed between said two laterally spaced portions, each of said tab members being integrally formed with both said base plate and one of said body members and acting to support one of said body members.

2. A louver panel as set forth in claim 1 wherein each of said tab members is disposed at an angle with respect to said base plate.

3. A louver panel as set forth in claim 2 wherein said separate body members are entirely inside the plane of said base plate.

4. A louver panel as set forth in claim 1 wherein said plurality of openings are generally rectangular in shape.

5. A louver panel as set forth in claim 1 wherein said side edges and said end edges are deformed in a direction away from said base plate and towards each said body members so as to provide a ridge around each of said plurality of openings.

* * * * *